United States Patent [19]

Lewis

[11] Patent Number: 4,961,843

[45] Date of Patent: Oct. 9, 1990

[54] LEWIS ECONOSIZER FOR HYDRAULICALLY CLASSIFYING PARTICLES

[76] Inventor: Robert M. Lewis, 15 Valley View Dr., Candler, N.C. 28715

[21] Appl. No.: 335,815

[22] Filed: Apr. 10, 1989

[51] Int. Cl.[5] ..... B03B 5/66

[52] U.S. Cl. ..... 209/210; 209/155; 209/158; 210/521

[58] Field of Search ..... 209/208, 210, 157, 158, 209/155, 460, 461; 210/801, 519, 521

[56] References Cited

U.S. PATENT DOCUMENTS

| | | | |
|---|---|---|---|
| 2,285,893 | 6/1942 | Boosey | 210/519 |
| 3,308,951 | 3/1967 | Evans | 209/158 |
| 3,367,495 | 2/1968 | Lea et al. | 209/157 X |
| 3,550,773 | 12/1970 | Villani et al. | 209/158 X |
| 3,933,654 | 1/1976 | Middelbeek | 210/521 |
| 4,033,863 | 7/1977 | Stone | 209/159 |
| 4,554,066 | 11/1985 | Turbitt | 209/159 X |
| 4,810,370 | 3/1989 | Taskinen | 209/158 X |

FOREIGN PATENT DOCUMENTS

| | | | |
|---|---|---|---|
| 1282896 | 1/1987 | U.S.S.R. | 209/208 |
| 27525 | of 1911 | United Kingdom | 209/210 |

*Primary Examiner*—Donald T. Hajec

*Attorney, Agent, or Firm*—David M. Carter; John E. McRae

[57] ABSTRACT

A particle separator comprising a liquid column having a liquid admission point located above the column lower end. Coarse size particles migrate downwardly to a hopper in the columns lower end. Carrier liquid flows upwardly through the column; fine size particles are removed at different levels along the liquid path.

8 Claims, 1 Drawing Sheet

LEWIS ECONOSIZER FOR HYDRAULICALLY CLASSIFYING PARTICLES

BACKGROUND OF THE INVENTION

This invention relates to a particle separator construction especially useful in the mining and mineral processing industries.

Many mineral processing facilities require separation of particles in size ranges finer than 14 mesh (1.168 mm). Use of wet screen techniques is not entirely satisfactory, due to such problems as screen hole plug-up (blinding), high maintenance costs associated with screen wear, and high initial equipment costs. It has been proposed to use hydraulic classifiers to overcome some of the disadvantages of wet screen installations.

Several types of hydraulic classifiers are available; they overcome some of the disadvantages of screen. However, these hydraulic classifiers are in many instances very large and sophisticated, and are thus costly to purchase. Additionally, they have relatively high maintenance costs and are difficult to properly control.

SUMMARY OF THE INVENTION

My invention relates to a hydraulic classifier (or wet sizer), wherein the particle-containing liquid is fed into a vertical column at a point near the bottom of the column vertical dimension. The column is designed so that the liquid is caused to flow upwardly therein, whereby coarse size particles gravitate downwardly through a slot at the top end of a sloped plate out of the upflowing stream into a hopper at the lower end of the column.

Liquid flow in the column is primarily unidirectional (i.e. upward) such that all of the particles start moving in the same direction. The arrangement is believed to be more efficient than conventional top-fed column units wherein finer size particles proceed upwardly through the liquid phase to effect their separation while at the same time larger size particles are moving downwardly through the same liquid phase.

Classifiers according to my invention can be designed to separate particles in a broad size range from 14 mesh (1.168 mm) down to 42 microns My invention has the following general advantages:

1. low initial equipment cost.
2. usable without building modifications or foundations.
3. relatively low maintenance costs.
4. susceptible to use of automatic controls.
5. relatively high efficiency and low operations costs.
6. less equipment surface pool area than other hydraulic classifiers.
7. capable of quick switch-over from one size range to another.
8. offers a choice of particle size ranges.
9. can act as a deslimer.
10. operates as a gravity separator.
11. has minimum surface area per unit weight of ore (or other particulates) processed.
12. All of the ore (particulates) does not go through the unit, as in conventional top fed sizers. Coarse material is separated out in the lower section of the unit without getting into the upper chamber. Therefore a much smaller unit is possible.
13. High density pulp can be withdrawn from middlings and coarse product outlets.

THE DRAWINGS

FIG. 1 is taken on line 1—1 in FIG. 2.

Figure 1:
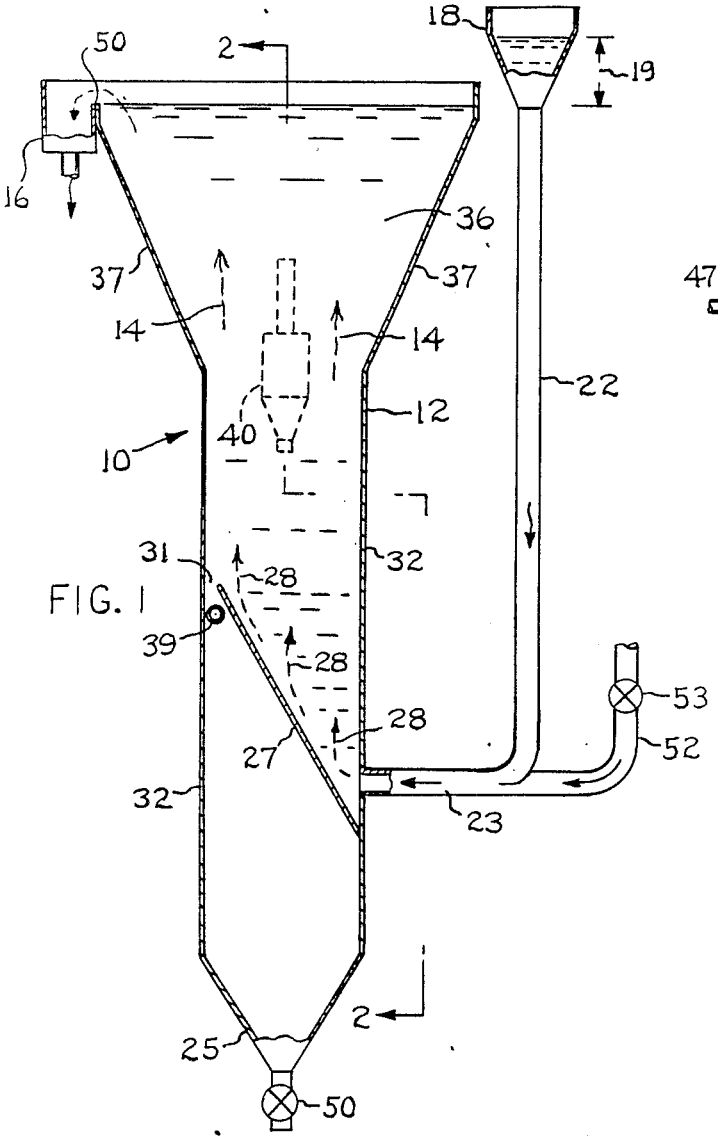
FIG. 1 is a sectional view of an apparatus embodying my invention.
Figure 4:
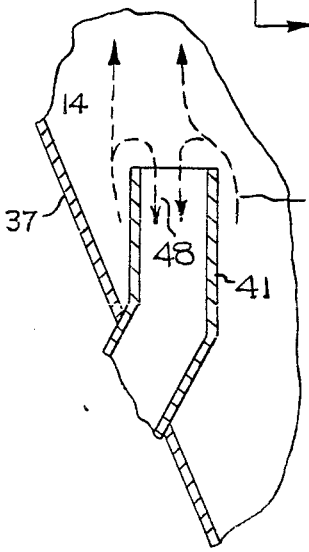

FIG. 4. is an enlarged view of a structural detail used in the FIG. 1 apparatus

DESCRIPTION OF A PREFERRED EMBODIMENT OF THE INVENTION

FIG. 1 shows one form that my invention can take. The structure there shown is a particle separator 10 comprising a liquid-containment column 12 designed to extend vertically. Liquid (with entrained particles) is caused to flow upwardly within the column, as indicated by arrows 14 and 28 in FIG. 1. Relatively clear (particulate free) effluent, slime, or extreme fine size particles according to desired separation, is discharged from the upper end of the column into a box (tray) 16.

The feed liquid (containing particulates of varying size) is initially fed into a hopper 18 located a predetermined distance 19 above the upper end of column 12. A pipe 22 extends downwardly from hopper 18 and thence laterally, as at 23, to connect with the side wall of the column. Pipe section 23 defines the admission point of the feedstock liquid into the column. The movement of material through the column is controlled by auxillary water added at 52. The admission point is a considerable distance below the upper end of the column, but above the column lower end (defined by hopper 25). The hopper is for retaining the accumulated coarse material and is not considered as taking part in the sizing separation.

Liquid is discharged from pipe section 23 onto an inclined baffle plate 27 fixedly located in the column at a point in horizontal registry with pipe section 23. Plate 27 is tapered from its upper left edge to its lower right edge to form a modified inverted pyramid section. Plate 27 redirects the liquid (and entrained particulates) to flow upwardly in the column, as indicated by arrows 28 and 14 in FIG. 1. The exact inclination of plate 27 is not critical to practice of the invention However an inclination angle of about sixty degrees it thought to give satisfactory results.

Plate 27 extends upwardly (and leftwardly) from a point slightly below the liquid admission point to a point almost, but not quite, reaching the opposite side wall of the column. The upper left edge of plate 27 is spaced a slight distance from the adjacent column side wall to define an overflow gap 31. The term "overflow" is used to indicate a potential for coarse particles to flow downwardly through the gap into hopper 25.

Column 12 has an essentially square cross section, at least in the zone thereof that contains baffle plate 27. Each of the four column side walls 32 is a flat vertical wall arranged at right angles to the other column side walls. The column could have a round, oblong or other cross section. However, a square cross-sectional configuration represents the preferred construction.

The baffle plate redirects the entrance velocity or flow from admission point 23 so that the material will be given a start up the vertical column. The coarse size particulates cannot rise at the prevailing upward flow velocity, and are thus forced to flow down through slot 31 at the top end of the baffle plate.

Liquid reaching overflow gap 31 contains mostly coarse size particles with some fine size particles. There is a potential for some of the fine size particles to move downwardly through gap 31. To prevent such action, I provide an auxillary liquid water header just below gap 31. The water header comprises a horizontal pipe 39 having a series of closely spaced openings in its upper surface An auxillary water source feeds water into pipe 39, whereby water jets are directed upwardly toward gap 31. A valve in pipe 39 is adjusted so that the upward flow out of the pipe is just enough to prevent the fine size particles in stream 28 from moving downwardly through gap 31 into collecting hopper 25. However the flow is not so great as to prevent the coarse size particles from moving downwardly through gap 31 into collecting hopper 25.

The finer size particles in the upflowing liquid stream are carried upwardly within the stream into an outwardly flaring column section 36 defined by four flat walls 37. The flaring nature of column section 36 causes the liquid to have a progressively lower vertical velocity as it moves upwardly toward the extreme upper end of column section 36. The progressively lowered velocity is advantageous in that it promotes separation of finer size particles.

Figure 2:
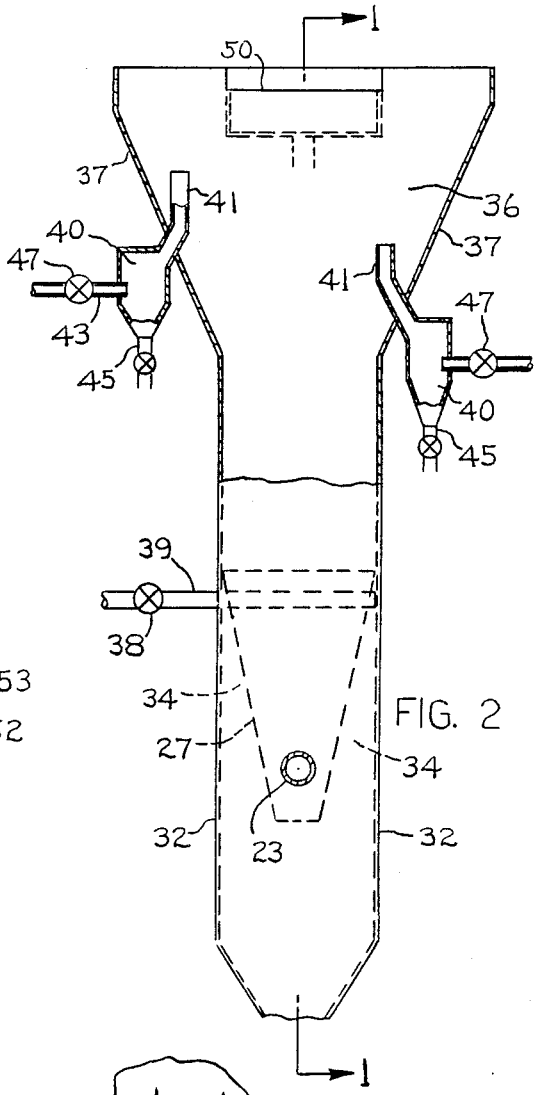
FIG. 2 is a sectional view taken essentially on line 2—2 in FIG. 1.
Figure 3:
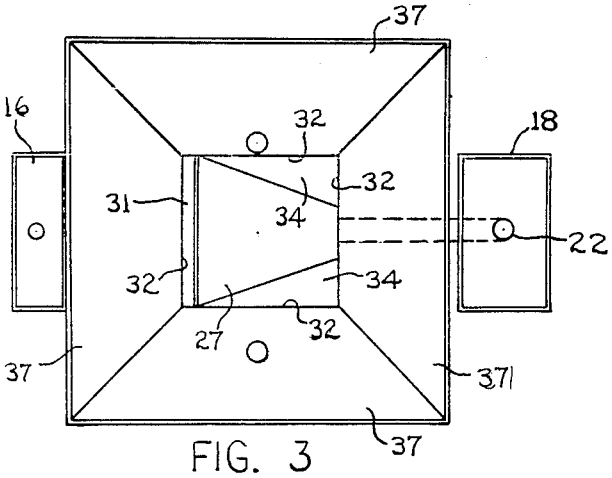
FIG. 3 is a top plan view of the FIG. 1 apparatus.

As shown in FIG. 2, two similar separation mechanisms are connected to the upper flaring section of the column. Each separating mechanism comprises a collecting chamber 40 connected to flaring section 36 of the column via an upstanding conduit 41. A liquid supply line 43 admits clear liquid to each chamber 40. Sized particles (with some liquid) are discharged from the separator chamber via a valved discharge outlet 45.

A valve 47 in each line 43 is adjusted so the water will flow up through conduit 41 at a rate which will prevent withdrawl of unwanted extreme fines but will permit withdrawl of desired size products. Although two of these intermediate sized withdrawl separator mechanisms are shown, additional units may be incorporated in the separator assembly.

If valve 47 is adjusted so that line 43 flow is slightly less than the flow through particle discharge outlet 45 than a slight downflow of liquid through conduit 41 can be realized, with some associated increase in particle separation action. The two separation mechanisms are located at different elevations on the flaring section of column 12. Vertical velocities at the respective conduits 41 are therefore different, such that the respective conduits remove particulates in different size ranges. The upper conduit removes the finer size particles. Substantially clear effluent, slimes, or extreme fines are discharged over a weir 50 into box 16.

The drawings show single conduits 41 at each specific separation level; additional conduits can be provided at each given level.

During operation of the particle separator, coarse size particulates may be continuously withdrawn from column 12 through a valved outlet 50 at the lower end of the hopper 25.

The various control valves 38, 47, 50, etc. may be operated manually or automatically, using various known types of sensors, e.g. flow sensors, or pressure sensors, or particle concentration sensors. The control system can be reasonably simple.

Auxiliary water line 52 is used to regulate the flow through the column vertical section and is the means by which particle sizing is established. Adjustment of valve 53 to increase the flow through pipe 52 will result in an increased fluid upflow through the vertical column 12. This will enable larger sized particles to be carried upwardly toward the separator mechanisms in flaring column section 36. Conversely, reducing the flow through pipe 52 will reduce the rate of flow of the upflowing liquid in column 12, thereby reducing the particle sizes that can move upwardly through the column.

Overall, the system is a relatively low cost mechanism that has reasonably low maintenance costs. Floor space requirements for the equipment are relatively small.

I claim:

1. A particle separator for treating a liquid containing relatively coarse particles and relatively fine particles; said separator comprising a vertically extending liquid-containment column; said column comprising first and second vertically-extending side walls facing each other in spaced opposed relationship; an inclined baffle plate extending angularly from said first side wall toward said second side wall; said baffle plate having a lower edge connected to said first side wall and an upper edge spaced a slight distance from said second side wall to provide a gap therebetween, for separating relatively coarse particles out of the liquid; means in said first side wall for admitting the particle-containing liquid into the column; said admitting means being located above the lower edge of said baffle, whereby the baffle causes the particle-containing liquid to flow upwardly through the column; a hopper connected to the lower end of the column for receiving relatively coarse particles that have passed downwardly through said gap; and a liquid header (39) located below said gap for directing jets of liquid upwardly through the gap so as to prevent relatively fine particles in the liquid from moving down through the gap.

2. The particle separator of claim 1, wherein the portion of the column that contains the inclined baffle plate has a square cross-section, whereby they gap between the baffle plate upper edge and said second side wall has a rectangular shape; said liquid header (39) being comprised of a horizontal pipe extending below the gap in parallel relation to the upper edge of the baffle plate; said pipe having a series of closely spaced flow openings along its upper surface for discharging jets of liquid upwardly toward the gap.

3. A particle separator for treating a liquid containing relatively coarse particles and relatively find particles; said separator comprising a vertically-extending liquid-containment column; said column comprising first and second parallel vertically-extending side walls facing each other in spaced opposed relationship; an inclined baffle plate extending angularly from said first side wall toward said second side wall; said baffle pate having a lower edge connected to said first side wall and an upper edge spaced a slight distance from said second side wall to provide a gap therebetween, for separating relatively coarse particles out of the liquid; means in said first side wall for admitting the particle-containing liquid into the column; said admitting means being located above the lower edge of said baffle, whereby the baffle causes the particle-containing liquid to flow upwardly through the column; means (at 52) for adding clear liquid to the particle-containing liquid at a point upstream from the column admission point; and a hopped connected to the lower end of the column for receiving relatively coarse particles that have passed downwardly through said gap.

4. The particle separator of claim 3, and further comprising a liquid supply hopper (18) adapted to have a liquid level spaced a predetermined distance (19) above the liquid level in said column; and a downflow pipe (22) extending from said liquid supply hopper to said liquid admission means in said first side wall of the column; said means for adding clear liquid being connected to said downflow pipe.

5. A particle separator for treating a liquid containing relatively coarse particles and relatively fine particles; said separator comprising a vertically-extending liquid-containment column; said column comprising first and second vertically-extending side walls facing each other in spaced opposed relationship; an inclined baffle plate extending angularly from said first side wall toward said second side wall; said baffle plate having a lower edge connected to said first side wall and an upper edge spaced a slight distance form said second side wall to provided a gap therebetween, for separating relatively coarse particles out of the liquid; means in said first side wall for admitting the particle-containing liquid into the column; said admitting means being located above the lower edge of said baffle, whereby the baffle causes the particle-containing liquid to flow upwardly through the column; and a hopper connected to the lower end of the column for receiving relatively coarse particles that have passed downwardly through said gap; the portion of the column that contains the inclined baffle plate having a substantially constant cross section in the horizontal direction; said column including an upper portion that flares outwardly from the substantially constant cross section portion, whereby the upflowing liquid will then have a gradually lower flow rate as it moves upwardly through the flared portion of the column.

6. The particle separator of claim 5, and further comprising at least one particle separating unit (40) located in the flared portion of the column.

7. The particle separator of claim 6, wherein there are at least two particle separator units located at different elevations in the flared portion of the column.

8. The particles separator of claim 6, wherein each particle separator unit comprises an upstanding conduit (41) within the column, a separator chamber (40) communicating with the lower end of said upstanding conduit, means (43) for admitting a controlled quantity of liquid into said separator chamber, and a valved discharge outlet (45) connected to said separator chamber.

* * * * *